US010066352B2

(12) United States Patent
Rogers

(10) Patent No.: US 10,066,352 B2
(45) Date of Patent: Sep. 4, 2018

(54) SNOW AND ICE CLEARING VEHICLE

(71) Applicant: Renardo Rogers, Calumet City, IL (US)

(72) Inventor: Renardo Rogers, Calumet City, IL (US)

( * ) Notice: Subject to any disclaimer, the term of this patent is extended or adjusted under 35 U.S.C. 154(b) by 0 days.

(21) Appl. No.: 15/184,278

(22) Filed: Jun. 16, 2016

(65) Prior Publication Data

US 2016/0369467 A1 Dec. 22, 2016

Related U.S. Application Data

(60) Provisional application No. 62/180,319, filed on Jun. 16, 2015.

(51) Int. Cl.
*E01H 5/10* (2006.01)
*E01H 5/04* (2006.01)
*E01H 5/09* (2006.01)

(52) U.S. Cl.
CPC ..... *E01H 5/102* (2013.01); *E01H 5/045* (2013.01); *E01H 5/092* (2013.01); *E01H 5/108* (2013.01)

(58) Field of Classification Search
CPC ..... E01H 5/102; E01H 5/045; E01H 5/092; E01H 5/108
See application file for complete search history.

(56) References Cited

U.S. PATENT DOCUMENTS 1,376,741 A 5/1919 Boyle
3,766,586 A * 10/1973 Krickovich ..... E01H 5/104 15/340.3
4,033,055 A * 7/1977 Lazarecky ..... E01H 5/02 126/271.2 A
4,164,820 A * 8/1979 Krickovich ..... E01H 1/0845 15/340.3
4,226,034 A * 10/1980 Benjamin ..... E01H 5/106 126/271.2 C
5,630,286 A * 5/1997 Vanderlinden ..... E01H 1/001 15/322
7,484,321 B1 * 2/2009 Stafne, Sr. ..... E02F 3/401 37/227
7,814,898 B2 10/2010 Rumbaugh
8,381,420 B1 2/2013 Hippie et al.
8,428,446 B1 4/2013 Pimentel
2009/0282707 A1 11/2009 Shenouda

* cited by examiner

*Primary Examiner* — Tara Mayo-Pinnock
(74) *Attorney, Agent, or Firm* — Global Intellectual Property Agency, LLC; Jordan Sworen

(57) ABSTRACT

A snow and ice clearing vehicle. The vehicle provides a combination of systems configured to facilitate the clearance and removal of snow and ice from roadways and sidewalks. The vehicle includes a snow clearing device, a heating system, and a suction system in communication with a reservoir. The snow clearing device is positioned on the front of the vehicle, wherein the heating system is positioned posterior to the snow clearing device and configured to apply heat to snow and ice not completely cleared by same. The suction system is positioned posterior to the heating system and configured to vacuum snow melted and loosened by the heating system. The reservoir is configured to retain water and snow captured by the suction system. The vehicle further includes a pump, wherein the pump is configured to remove the water from the reservoir through an outlet to an area remote from the vehicle.

16 Claims, 2 Drawing Sheets

SNOW AND ICE CLEARING VEHICLE

CROSS REFERENCE TO RELATED APPLICATIONS

This application claims the benefit of U.S. Provisional Application No. 62/180,319 filed on Jun. 16, 2015. The above identified patent application is herein incorporated by reference in its entirety to provide continuity of disclosure.

BACKGROUND OF THE INVENTION

The present invention relates to vehicles for clearing snow. More specifically, the present invention relates to a snow and ice clearing vehicle including a combination of systems including a snow clearing device, a heating system, a suction system, and a reservoir for collecting and removing snow and ice from roadways and sidewalks.

Maintaining roadways during the winter months can be a very difficult task to accomplish due to the accumulation of snow and ice formed by heavy precipitation and cold temperatures. To maintain roadways, both private individuals and governments currently use machines and devices that displace snow, rather than remove it, e.g. snow plows, snow blowers, shovels, and so on. However, displaced snow can get in the way of pedestrians and motorists, can build up and cause problems, e.g. flooding, when it melts, and can hide ice that is extremely dangerous for motorists. Therefore, there is a need in the prior art for a vehicle that removes snow and ice from roadways as opposed to merely displacing them.

SUMMARY OF THE INVENTION

In view of the foregoing disadvantages inherent in the known types of snow removal devices now present in the prior art, the present invention provides a snow and ice clearing vehicle wherein the same can be utilized for providing convenience for the user when removing snow and ice from roadways and sidewalks. The present system comprises a snow clearing device having one or more heating elements disposed thereon, the snow clearing device disposed on a front of the vehicle; a heating system disposed posterior to the snow clearing device on an undersurface of the vehicle; a suction system disposed posterior to the heating system on the undersurface of the vehicle; a reservoir in fluid communication with the suction system, the reservoir configured to receive fluid from the suction system; an outlet in communication with the reservoir; a pump coupling the reservoir to the outlet; a salt spreader disposed on a rear of the vehicle; and a scrubber.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
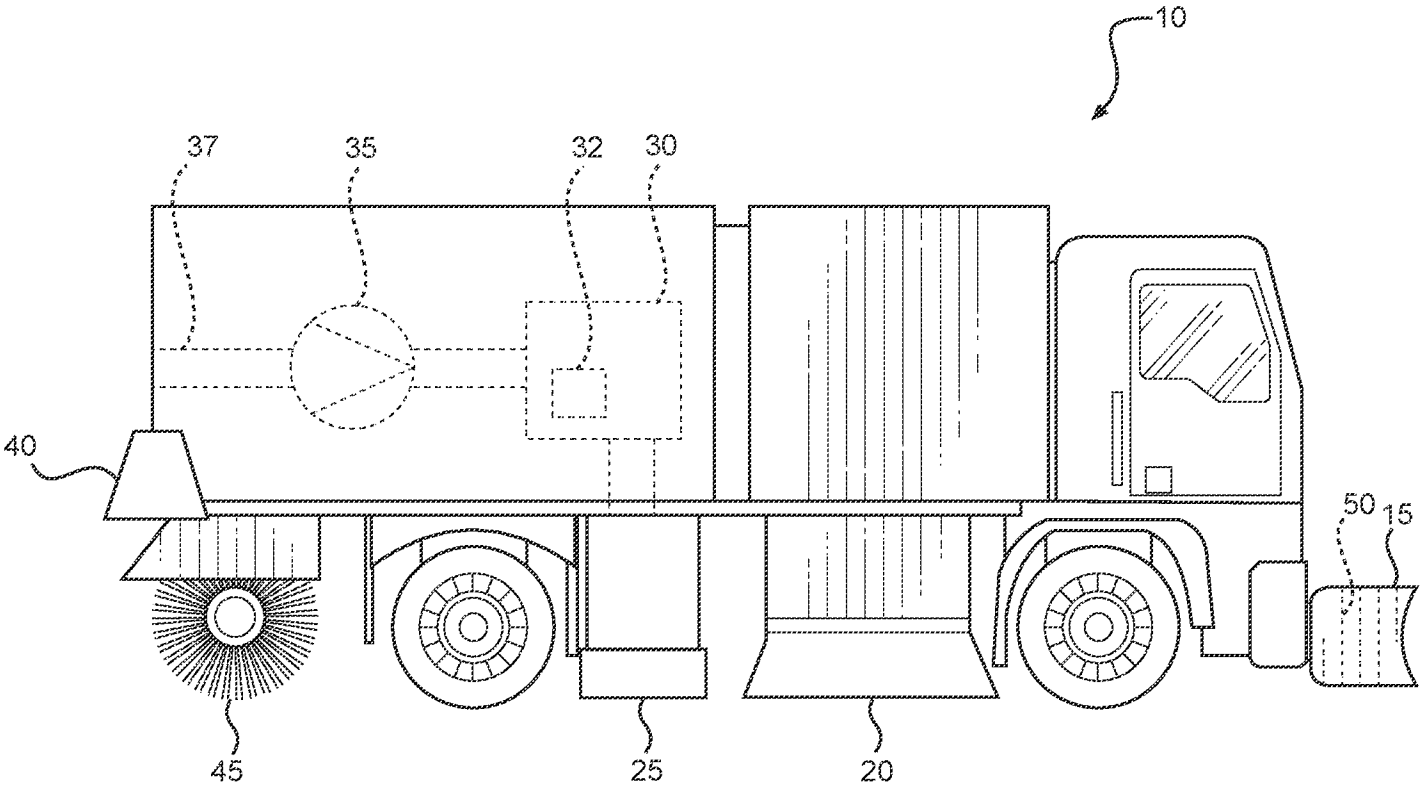
FIG. 1 shows a diagram of the snow and ice clearing vehicle and its components according to one embodiment of the present invention.

Reference is made herein to the attached drawings. Like reference numerals are used throughout the drawings to depict like or similar elements of the snow and ice clearing vehicle. For the purpose of providing a brief and clear description of the present invention, the preferred embodiment will be discussed as comprising an automobile, such as a truck. The figures are intended for representative purposes only and should not be considered to be limiting in any respect.

Referring now to FIG. 1, there is shown a diagram of the snow and ice clearing vehicle and its components according to one embodiment of the present invention. The snow and ice clearing vehicle 10 provides a truck for facilitating the complete removal of snow and ice from roadways and sidewalks. The snow and ice clearing vehicle 10 includes a snow clearing device 15, a heating system 20, a suction system 25, a reservoir 30 for collecting liquids, a pump 35, and a salt spreader 40. In an alternative embodiment, the snow and ice removal vehicle 10 further comprises one or more scrubbers 45 for scrubbing a roadway in order to remove any remaining ice or snow left thereon.

The snow clearing device 15 of the snow and ice clearing vehicle 10 comprises one or more heating elements 50 disposed thereon for heating and melting snow while plowing same. In one embodiment, the snow clearing device 15 comprises a snow plow, wherein the snow plow is disposed on the front of the vehicle 10 and the heating elements 50 are positioned along the surface of the blade of the snow plow. The heating elements 50 can be placed such that they are evenly spaced apart from one another. In one embodiment, the snow plow is removably attached to the grill of the vehicle 10. In another embodiment, the snow plow is removably attached to the undercarriage or chassis of the vehicle 10.

The heating system 20 of the snow and ice clearing vehicle 10 is disposed on the undercarriage of the vehicle 10. The heating system 20 is configured to apply heat to the surface of a roadway and melt any remaining snow and ice not cleared or captured by the snow clearing device 15. The heating system 20 comprises a heating surface, which is the point at which the heat generated by the heating system is emanated. In this way, the heating system 20 acts as a second measure in the removal of snow and ice, after the snow clearing device 15. In one embodiment, the heating system 20 is disposed posterior to the snow clearing device 15, such that any snow or ice not cleared by the snow clearing device 15 is melted and/or loosened by the heating system 20. In one embodiment, the heating system 20 comprises a space heating system including a forced air furnace having a forced air distribution system, wherein the furnace generates heat and drives high pressure hot air through a duct that is disposed underneath the vehicle and positioned adjacent and towards the ground, such that it is proximate to the pavement of a roadway when in use. In this way, the hot air generated from the furnace is fully concentrated towards the roadway by the air duct, thereby melting any remaining snow or ice not cleared by the snow clearing device 15.

The suction system 25 is disposed on the undercarriage of the snow clearing vehicle 10. The suction system 25 is configured to suck up any liquids or loose snow melted by the heating system 20 or not removed by the snow clearing device 15. The suction system 20 comprises an inlet, wherein the inlet is the point of entry through which material is suctioned into the vehicle 10. In this way, the suction system 25 acts as a third measure in the removal of snow and ice. In one embodiment, the suction system 25 is positioned posterior to the heating system 20 in order to collect the melted water or liquid and/or loosened snow formed by the heating system 20. In another embodiment, the suction system 25 comprises an industrial self-contained vacuum pump, such as an Industravac®, a Fast-Vac™, or a vacuum excavator-type vacuum pump, wherein the vacuum is disposed directly behind the heating system 20 and positioned towards and directly above the ground, such that it is proximate to the pavement of a roadway when in use. In this way, the suction created by the vacuum is applied incident to the roadway such that the snow melted by the heating system 20 is sucked up and captured by the vacuum.

The reservoir 30 of the snow and ice clearing vehicle 10 is in fluid communication with the suction system 25. The reservoir 30 comprises an interior volume configured to collect the water and/or snow sucked up by the suction system 25 and retain it therein. The reservoir 30 comprises a heating element 32 for heating the interior volume for melting loose snow and for preventing the liquid sucked thereinto from freezing in colder temperatures. The snow and ice clearing vehicle 10 further comprises an outlet 37 in communication with the reservoir 30 for facilitating the removal of the water therein to a waste system, a holding tank, or another such structure external to the vehicle 10. The outlet 37 is operably coupled to a pump 35, wherein the pump 35 is configured to pump the fluids from the reservoir 30 through the outlet 37, thereby removing fluid retained in the reservoir 30 from the vehicle 10. In one embodiment, the outlet 37 is a pipe ending at an opening on the exterior surface of the vehicle 10, wherein the pipe is operably coupled to the reservoir 30 and the provides a means for the fluids stored in the reservoir 30 to be moved from the reservoir 30 to the exterior of the vehicle 10.

The salt spreaders 40 of the snow and ice clearing vehicle 10 are configured to disperse salt while the vehicle 10 is being utilized. Each salt spreader 40 comprises a hopper for holding salt and an auger coupled to an actuator for mechanically spreading salt. In one embodiment, the actuator comprises an electric motor. In this way, the salt spreaders 40 act as a fourth measure in the removal of ice and snow from a roadway, insofar as they prevent ice from reforming. In one embodiment, the salt spreaders 40 are positioned in the rear of the vehicle 10 and are attached to the chassis. In alternative embodiments, the salt spreaders 40 are attached to the rear fender or tailgate of the vehicle 10.

In one embodiment of the present invention, the snow and ice clearing vehicle further comprises one or more scrubbers 45 configured to break up ice and dense snow. The scrubbers 45 are scrubbing devices comprising rotatable bristles actuable by an actuator. In one embodiment, the actuator is an electric motor. The scrubbers 45 are configured to scrub the surface of a roadway when passing thereover. In this way, the scrubbers 45 act as a fifth measure in the removal of snow and ice from a roadway, insofar as they aid in the breaking and loosening of ice and dense snow, which can then be subsequently cleared or captured by another snow clearing vehicle. The scrubbers 45 are positioned adjacent the ground and facing towards the ground, such that they are directly incident to the pavement of a roadway when in use. In one embodiment, the scrubbers 45 are positioned posterior to the suction system 25 and disposed and aligned on opposing sides, e.g. the left and right sides of the vehicle 10. In another embodiment, the scrubbers 45 are disposed on the undersurface of the vehicle 10 and positioned in between the snow clearing device 15 and the heating system 20. In this way, the scrubbers may help break up ice and dense snow not cleared or broken up by the snow clearing device 15, thereby exposing more snow and ice surface area to the heating system 20 before the heating system 20 passes thereover. In yet another embodiment, the scrubbers 45 are disposed on the undersurface of the vehicle 10 and positioned in between the heating system 20 and the suction system 25. In this way, any snow or ice loosened by the heat generated by the heating system 20 may be further broken up, thereby facilitating the suction of same by the suction system 25 when passing thereover.

Figure 2:
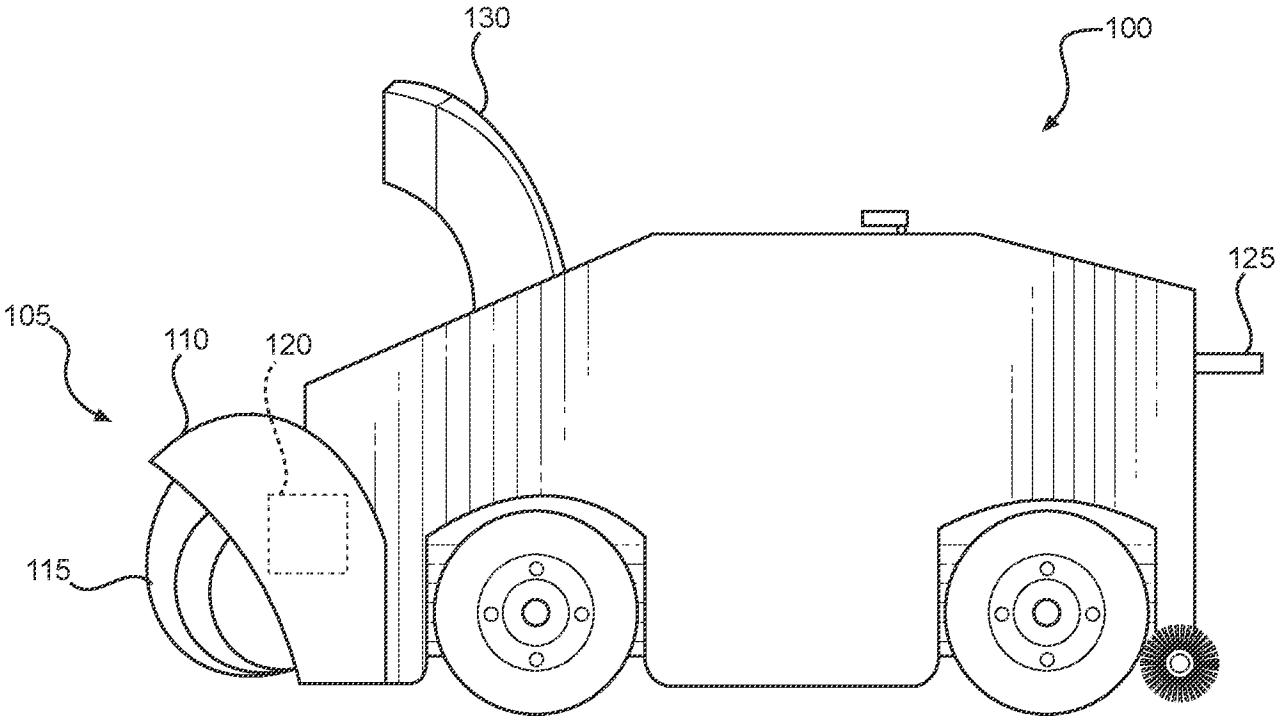
FIG. 2 shows a diagram of the snow and ice clearing vehicle and its components according to one embodiment of the present invention.

Referring now to FIG. 2, there is shown a view of the snow and ice clearing vehicle 10 according to one embodiment of the present invention. In a second embodiment, the snow clearing vehicle 100 comprises a push snow blower or snow thrower 105 capable of being pushed in order to clear or remove snow from a driveway or sidewalk. The snow thrower 105 comprises a snow receiving body 110 and an auger 115 having a bladed edge, wherein the snow thrower 105 is disposed on the front of the vehicle 100 and the heating elements 120 are positioned within the snow receiving body 110. The snow clearing vehicle 100 further comprises an adjustable spout 130, wherein the spout 130 is configured to drive snow from the snow thrower 105 in a desired direction. In some embodiments, the heating elements 120 are positioned on the auger 115. In other embodiments, the snow and ice clearing vehicle 100 comprises a handle 125 for pushing and/or pulling the snow and ice clearing vehicle 100 along a sidewalk or driveway to clear snow and ice that has accumulated thereon. In another embodiment, the handle 125 is disposed on the rear of the vehicle 100, however, in alternative embodiments, the handle 125 is disposed on the side or sides of the vehicle 100.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vehicle for clearing snow and ice, comprising:

a snow clearing device having one or more heating elements disposed thereon, the snow clearing device disposed on a front of the vehicle;

a heating system disposed posterior to the snow clearing device on an exterior undersurface of the vehicle, the undersurface disposed underneath the vehicle towards a ground surface;

a suction system disposed posterior to the heating system on the exterior undersurface of the vehicle;

a reservoir in fluid communication with the suction system, the reservoir configured to receive fluid from the suction system;

an outlet in communication with the reservoir;

a pump coupling the reservoir to the outlet.

2. The snow and ice clearing vehicle of claim 1, wherein the vehicle is a truck.

3. The snow and ice clearing vehicle of claim 1, further comprising a handle disposed on the rear of the vehicle.

4. The snow and ice clearing vehicle of claim 1, wherein the snow clearing device comprises a snow plow.

5. The snow and ice clearing vehicle of claim 1, wherein the snow clearing device comprises a snow thrower.

6. The snow and ice clearing vehicle of claim 1, wherein the heating system comprises a forced air furnace having a forced air distribution system configured to generate heat and drives high pressure hot air through a duct thereof.

7. The snow and ice clearing vehicle of claim 1, wherein the suction system comprises a vacuum excavator.

8. The snow and ice clearing vehicle of claim 1, wherein the reservoir comprises a heating element disposed therein, the heating element is configured to heat the contents of the reservoir.

9. The snow and ice clearing vehicle of claim 1, wherein a heating surface of the heating system is configured to be proximate to the ground surface.

10. The snow and ice clearing vehicle of claim 1, wherein an inlet of the suction system is configured to be proximate to the ground surface.

11. The vehicle for clearing snow and ice of claim 1, further comprising a salt spreader disposed on a rear of the vehicle.

12. The snow and ice clearing vehicle of claim 11, wherein the salt spreader is positioned posterior to the vacuum system.

13. The vehicle for clearing snow and ice of claim 1, further comprising a scrubber.

14. The snow and ice clearing vehicle of claim 13, wherein the scrubber is positioned posterior to the snow clearing device.

15. The snow and ice clearing vehicle of claim 14, wherein the scrubber is positioned in between the snow clearing device and the heating system.

16. The snow and ice clearing vehicle of claim 14, wherein the scrubber is positioned in between the heating system and the suction system.

* * * * *